US006890140B2

(12) United States Patent
Egerton et al.

(10) Patent No.: US 6,890,140 B2
(45) Date of Patent: May 10, 2005

(54) SEAM ADJUSTERS

(75) Inventors: Daniel Egerton, Bolton (GB); Miles Waterworth, Leeds (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 1 day.

(21) Appl. No.: 10/470,941

(22) PCT Filed: Jan. 29, 2002

(86) PCT No.: PCT/EP02/01043

§ 371 (c)(1),
(2), (4) Date: Aug. 5, 2003

(87) PCT Pub. No.: WO02/064282

PCT Pub. Date: Aug. 22, 2002

(65) Prior Publication Data

US 2004/0062625 A1 Apr. 1, 2004

(30) Foreign Application Priority Data

Feb. 9, 2001 (EP) ..... 01301186

(51) Int. Cl.[7] ..... B21D 51/26
(52) U.S. Cl. ..... 413/4; 413/27; 53/334

(58) Field of Search ..... 413/4, 5, 6, 7, 413/26, 27, 31, 35, 36, 37, 40, 41, 72, 74, 1, 8; 53/334, 340; 74/390

(56) References Cited

U.S. PATENT DOCUMENTS 5,839,869 A * 11/1998 Moran et al. ..... 413/31

FOREIGN PATENT DOCUMENTS

EP 468791 A1 * 1/1992 ..... B21D/51/26
JP 60-170543 * 9/1985 ..... B21D/51/32

* cited by examiner

*Primary Examiner*—Allen Ostrager
*Assistant Examiner*—Jimmy Nguyen
(74) *Attorney, Agent, or Firm*—Diller, Ramik & Wight

(57) ABSTRACT

A seam adjuster for ensuring that a tight seam is formed between a can end and a can body. The seam tool (32) is mounted via bearing (34) on the seam lever (31), the centre of the bearing being eccentric to its outside diameter. The bearing has an-external thread (35) which mates with a complementary worm mechanism (36). By virtue of the eccentricity, rotation of the worm mechanism rotates the bearing and moves the seam tool radially for adjusting seam tightness. Seam tool height is set by a spacer (33) or shim which is readily interchangeable for varying the seam tool height without affecting seam tool tightness.

11 Claims, 5 Drawing Sheets

SEAM ADJUSTERS

BACKGROUND OF THE INVENTION

This invention relates to seam adjusters and, in particular, it relates to adjusters for seamers to ensure that a tight seam is formed between a can end and a can body and that seam tightness is reproducible over long manufacturing runs.

Seaming technology is well established for forming typically a double seam in which a top or base can end component is rolled onto the can body flange in two operations. The can end has a seaming panel which is rolled onto the can body flange in the first operation and, in the second operation, the seam is ironed to the required tightness.

It is essential that the final seam is sufficiently tight to ensure compression of lining compound within the seam and consequent hermetic sealing. Other requirements such as sufficient overlap of body and end hooks may also need to be controlled. In manufacturing lines, the repeatability of the production of good seams is clearly also of paramount importance.

In order to ensure that required seam tightness can be both set and maintained so that the seam setting is repeatable over long manufacturing runs, seam adjustment devices are provided.

One known adjuster uses rotation of a worm screw to enable radial movement of a cam follower relative to the seam tool in order to adjust seam tightness. However, as the worm is located at the opposite end of the machine from the seam tool itself, setting and adjusting seam tightness is inconvenient. Furthermore, removal of second operation cam followers is required in order to perform a check on the first operation seam thereby making such inspection a lengthy procedure. Height adjustment of the seam tool is achieved by rotating a threaded seam tool shaft so that the shaft moves vertically. In this adjuster, access is required to both ends of the seaming shank.

This problem of access has been addressed in another adjuster in which a worm thread on the seam tool shaft mates with an adjustment screw for setting seam tightness. Height of the seam tool is varied by a screw adjuster. The screw adjuster has a flange which locates in a groove in the seam tool shaft. Both height and seam tightness adjustment thus act directly on the seam tool shaft. The worm thread on the seam tool shaft for seam tightness setting is therefore oversized so that vertical adjustment is still possible while maintaining mesh with the radial adjustment screw. As a result, some precision in the mechanism is lost and, when unlocking screws to set seam tool height, seam tightness settings may inadvertently be altered.

This invention seeks to overcome the problems of prior art seam adjusters.

SUMMARY OF THE INVENTION

According to the present invention, there is provided an apparatus for adjusting seam tightness settings on a seamer for seaming a can end to a can body, the apparatus including: a seaming shank which is rotatable about its longitudinal axis; a seam lever mounted on the seaming shank; and at least one seam tool mounted on the seam lever for forming a first and/or second operation seam between a can end and can body flange; characterised in that: the seam tool is mounted via a bearing on the seam lever, the centre of the bearing being eccentric to its outside diameter; and characterised by an external thread on the bearing which mates with a complementary worm mechanism, whereby rotation of the worm mechanism rotates the bearing and moves the seam tool radially for adjusting seam tightness.

The external thread on the bearing may be a thread cut on a housing for the bearing.

The worm adjustment of the present invention thus not only allows finer adjustment than in conventional seamers, but is also close to the seam tool, hence reducing the effects of backlash and play to a minimum.

In a preferred embodiment, a spacer is provided to set seam tool height. The spacer is ground to the correct thickness and is readily interchangeable without requiring resetting of seam tightness, being completely independent of any changes to seam tightness. Alternatively, a shim could be used to eliminate the need for grinding.

Ideally, the apparatus further comprises a second spacer for setting the height of the seam lever.

All adjustment components are thus independent of the seaming shank itself, and easily located at one end of the seamer. The spacers/shims are used to standardise the height settings on all seaming stations, thus allowing all seam levers to be interchangeable.

According to a further aspect of the present invention, there is provided a method of adjusting seam tightness settings on a seamer for seaming a can end to a can body, the seamer including a seam lever mounted on a seaming shank; and at least one seam tool mounted on the seam lever for forming a first and/or second operation seam between a can end and can body flange; the method being characterised by mounting the seam tool on the seam lever via a bearing which has an external thread, with the centre of the bearing eccentric to its outside diameter; engaging the external thread on the bearing with a complementary worm mechanism; and rotating the worm mechanism and the bearing mated thereto, thereby moving the seam tool radially and adjusting seam tightness.

BRIEF DESCRIPTION OF THE DRAWINGS

A preferred embodiment of the invention will now be described, by way of example only, with reference to the drawings, in which:

FIG. 2' is a cutaway view of the seam adjuster of FIG. 2;

DETAILED DESCRIPTION OF THE PREFERRED EMBODIMENTS

Figure 1:
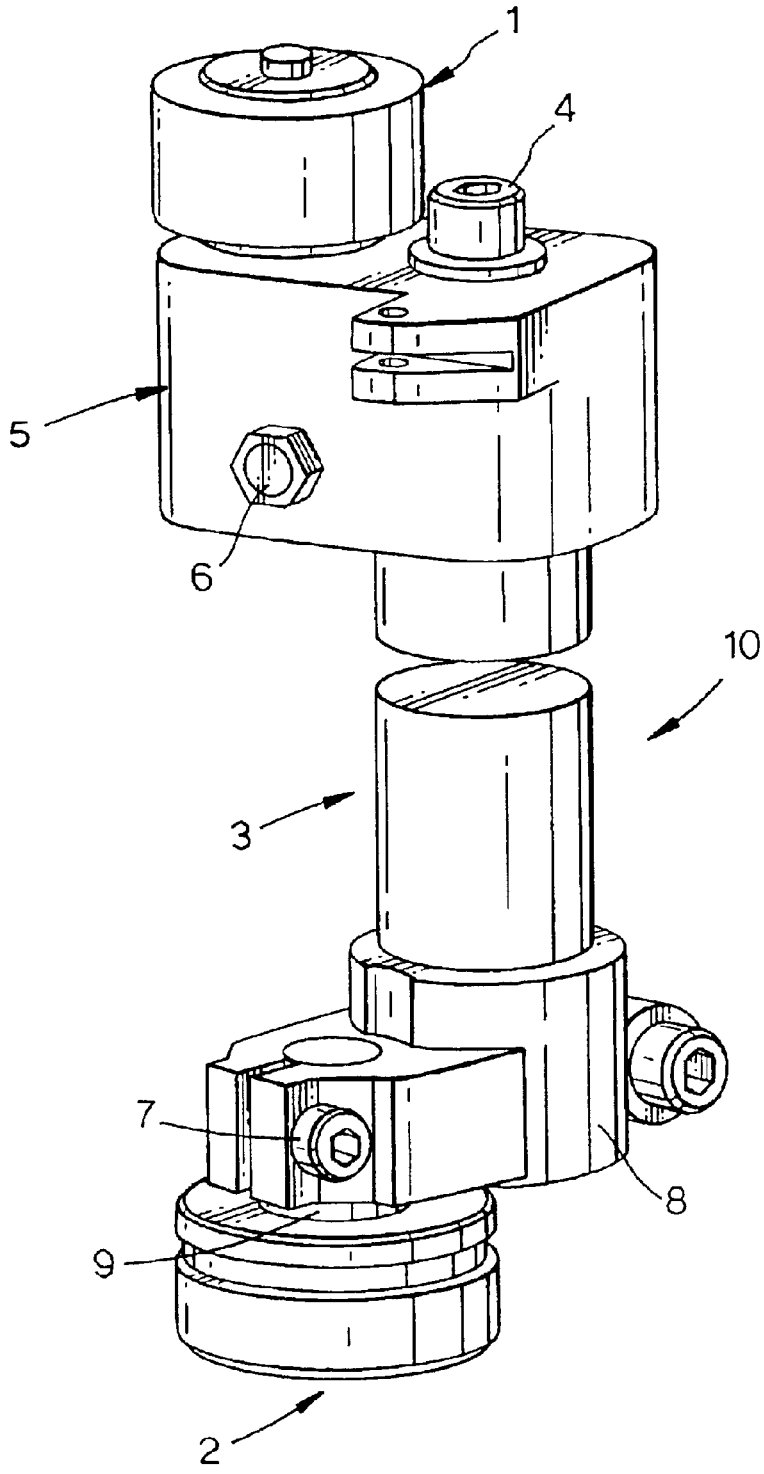
Fig.1. PRIOR ART
FIG. 1 is a perspective view of a prior art seam adjuster.

FIG. 1 shows a prior art seam tool 10 comprising a cam follower 1 and a single seam tool 2 at opposite ends of seaming shank 3. A locking screw 4 can be loosened to allow the cam lever 5 to rotate freely. A worm adjuster 6 is mated with a complementary worm thread (not shown) on the seaming shank 3.

In order to adjust seam tightness, locking screw 4 is loosened and the worm 6 is rotated. Rotation of the worm results in radial movement of the cam follower relative to the seam tool 2, thereby adjusting seam tightness. Adjustment is inconvenient since the worm adjustment 6 is at the top of the machine and the seam tool 2 is at the other end of the seaming shank 3. In addition, some precision may be lost due to play in the assembly.

In the prior art seamer of FIG. 1, seam tool height adjustment is achieved by loosening screw 7 and rotating seam tool shaft 9. The shaft 9 has a threaded portion so that rotation of the shaft results in a vertical movement. Since the portion of the seam tool shaft 9 which located in seam tool lever 8 is relatively short, difficulties may arise during height setting in ensuring that the seam tool remains perpendicular to seam lever 8.

Figure 2:
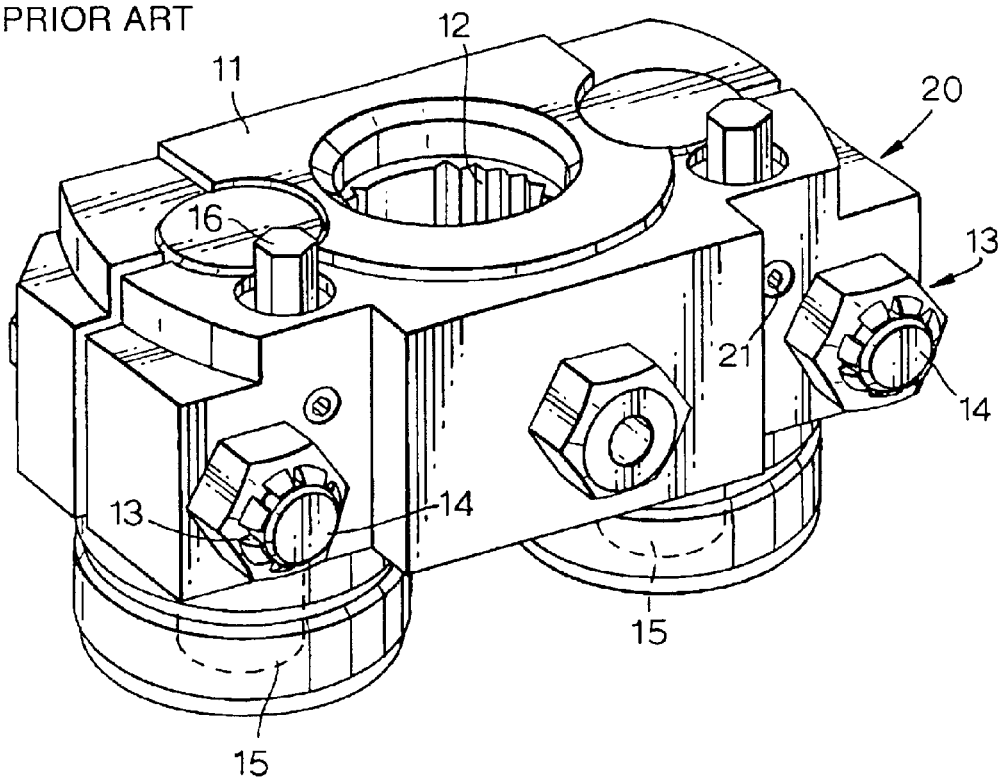
Fig.2. PRIOR ART
FIG. 2 is a perspective view of a second prior art seam adjuster.
Figure 2:
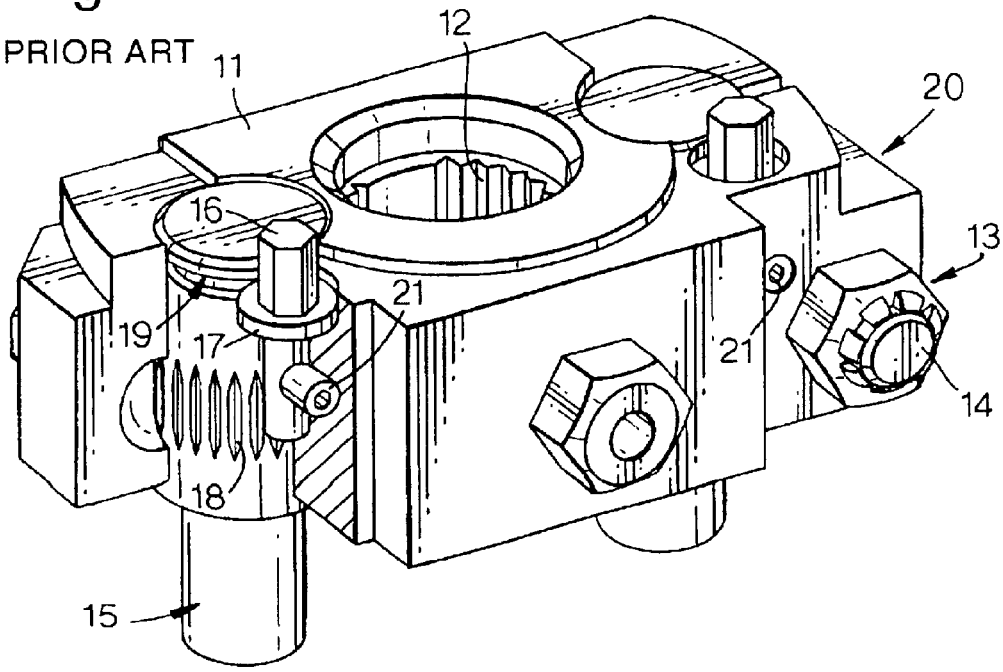
Fig.2' PRIOR ART

FIG. 2 shows an alternative seam adjustment tool 20 comprising a seam lever 11 which is locatable on the seaming shank by serration 12. To adjust seam tightness, nuts 13 are loosened to allow adjustment screws 14 to be turned. Each adjustment screw 14 mates with a worm thread 18 cut into an eccentric seam tool shaft 15 (see FIG. 2').

Seam tool height adjustment in the prior art embodiment of FIG. 2 uses a screw adjuster 16. A flange 17 on screw adjuster 16 (shown in the cutaway portion of FIG. 2') locates in a groove 19 cut into the seam tool shaft 15. A grub screw 21 maintains the setting.

From FIG. 2', it is apparent that setting seam tightness can affect seam tool height setting and vice versa. When setting seam tool height, seam tool shaft must be unlocked and seam tightness settings may alter unintentionally. Conversely, in order to allow vertical movement for seam tool height setting whilst still maintaining mesh with the radial adjustment screw 14 for seam tightness setting, the worm thread 18 is oversized. This "play" in the worm thread means that some precision in the mechanism is lost.

The disadvantages of these and other prior art seam adjusters are overcome by the tool 30 of the present invention, shown in FIGS. 3 to 8.

In contrast with known seam adjusters, adjusters for setting both seam tightness and seam roll height in the present invention are not only situated on the seam lever 31 adjacent the seam rolls 32 but are also independent of one another.

As shown in FIGS. 3 to 8, first and second operation seaming tools 32 are each mounted on a spacer 33 on a bearing 34. The external housing of the bearing has a thread 35 cut in it so as to mate with an adjacent worm screw 36. The bearings are, in turn, mounted on seam lever 31. The seam lever 31 is fixed by a retaining screw 39 to the seaming shank 37 at a height which is set by top hat spacer 38, ground to correct thickness.

Figure 3:
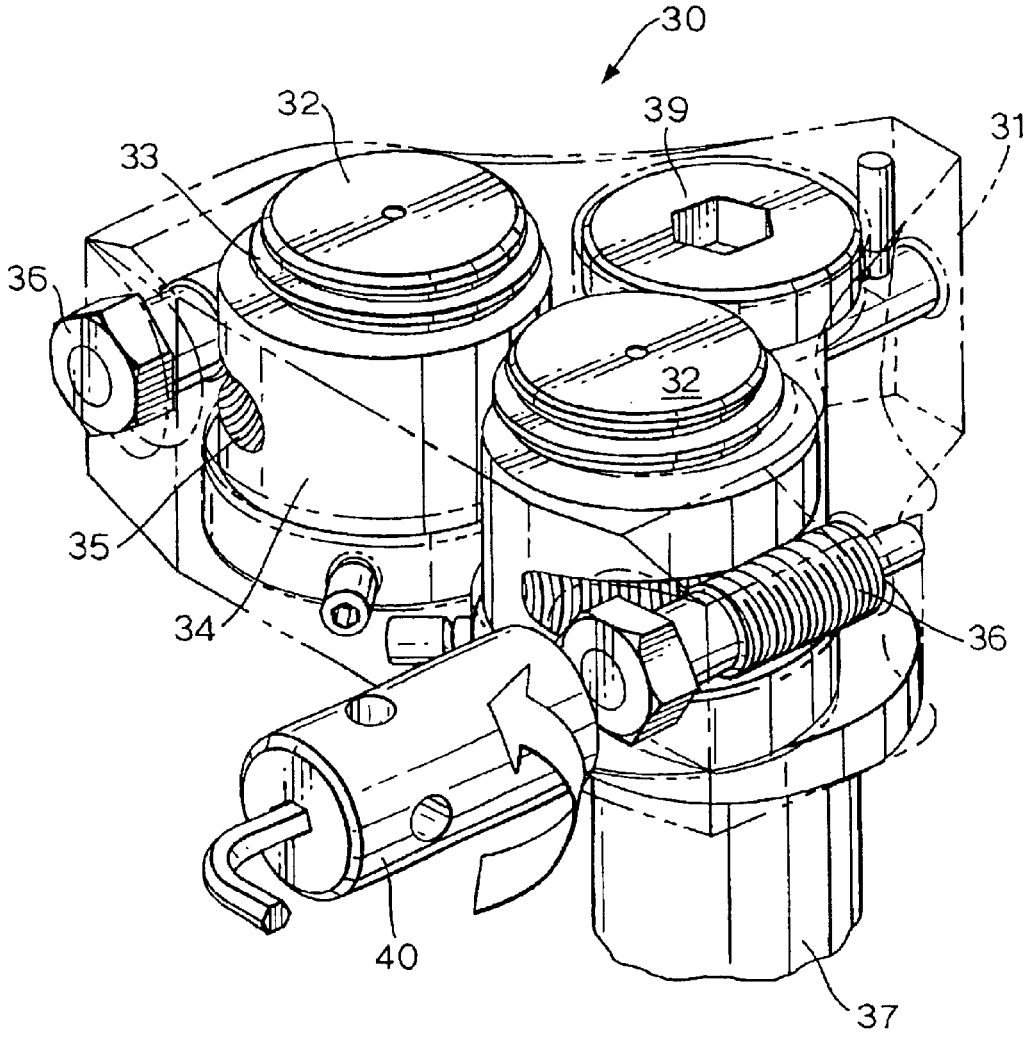
FIG. 3 is a perspective view of the seam adjuster of the present invention.
Figure 4:
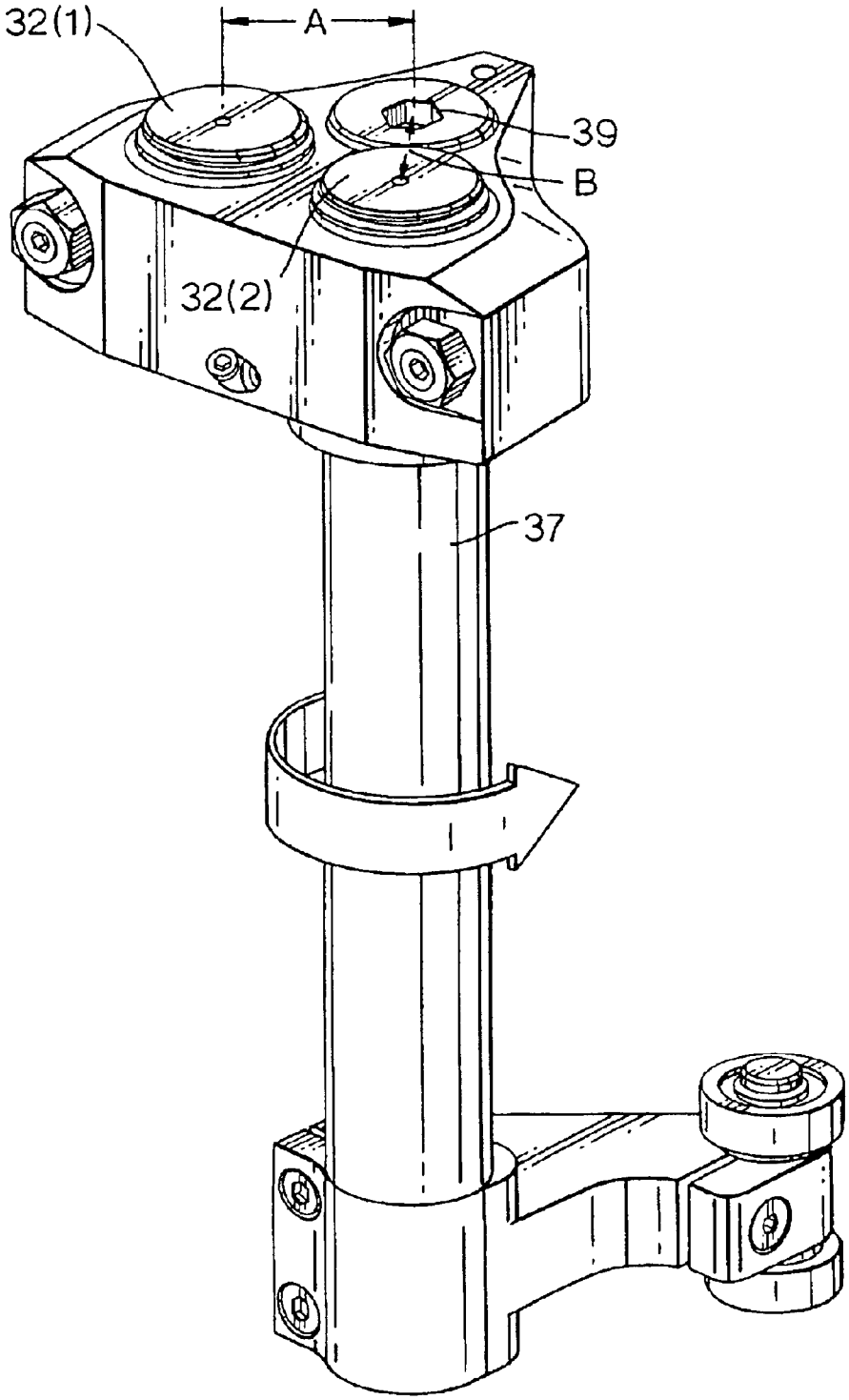
FIG. 4 is a schematic perspective view of the seam adjuster of FIG. 3.
Figure 6:
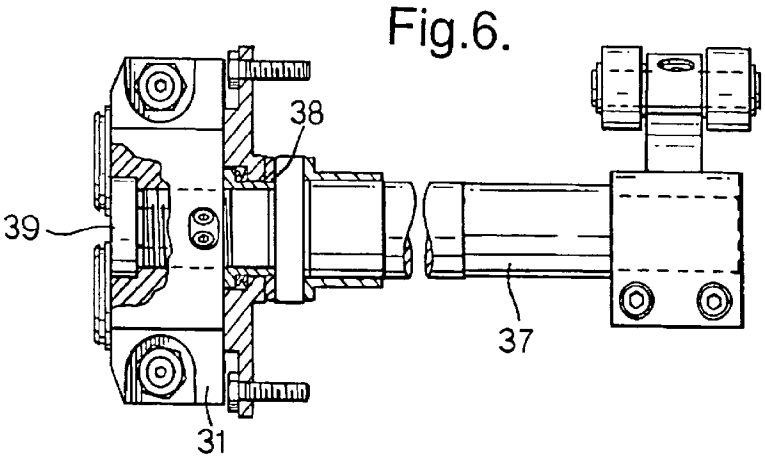
FIG. 6 is a side view of the seam adjuster of FIG. 5.
Figure 8:
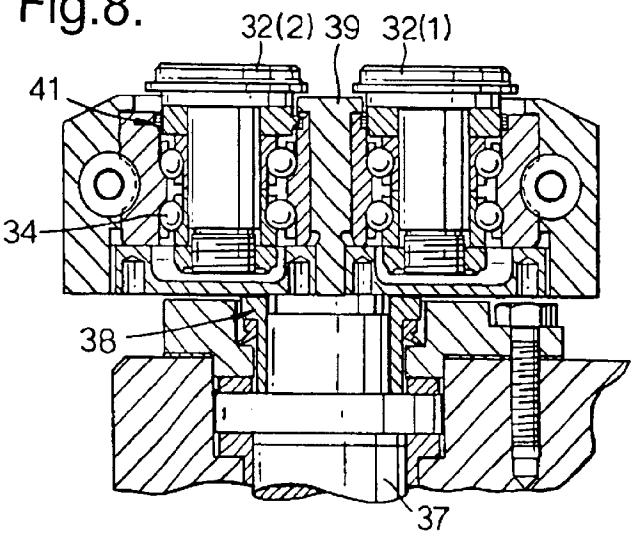
FIG. 8 is a side section of the seam lever of FIGS. 3 to 7.
Figure 5:
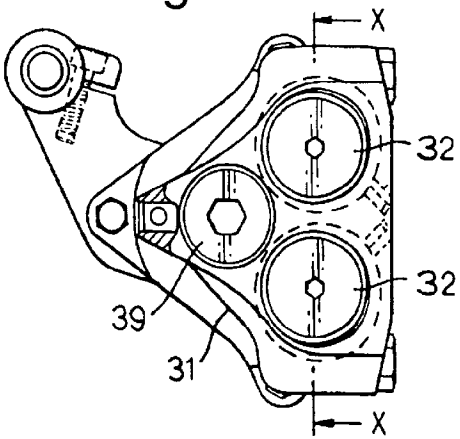
FIG. 5 is a plan view of the seam adjuster of FIG. 3.
Figure 7:
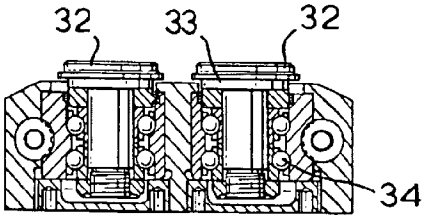
FIG. 7 is a side section along X-X of FIG. 5.

As best seen in FIGS. 3 and 8, the internal bore of bearing 34 is eccentric to its outside diameter. For adjustment of seam tightness, the bearing cap is loosened and the locking screw undone, enabling an adjustment tool 40 to mate with worm screw 36. The worm screw is rotated and the eccentricity of bearing 34 allows adjustment of the bearing radially towards or away from the axis of the seaming shank. This movement reduces or increases the corresponding distance "A" or "B" shown in FIG. 4 to adjust the seam tightness setting.

Seam roll height is fixed, completely independently of seam tightness, by virtue of spacer 33 or, alternatively, by a shim. By use of a spacer or shim to set the height of the seam roll, the setting does not alter when seam tightness is adjusted.

The bearing 34 further includes an integral sealing system comprising laminar rings 41 which form part of the bearing outer. By virtue of being an integral part of the bearing outer, the laminar sealing rings thus reduce time required for assembly and the complexity of assembly.

It can be seen that the seam adjuster of the present invention allows quick and straightforward seam adjustment, with access only required to the seam roll end of the apparatus. Seam roll height adjustment requires only removal of a roll to access the spacer, and seam lever height can be adjusted by removing only the seam lever to change the lever spacer 38 without requiring resetting of the components mounted on the seam lever.

Although a preferred embodiment of the invention has been specifically illustrated and described herein, it is to be understood that minor variations may be made in the apparatus without departing from the spirit and scope of the invention, as defined by the appended claims.

What is claimed is:

1. An apparatus for adjusting seam tightness settings on a seamer for seaming a can end to a can body, the apparatus including:

a seaming shank which is rotatable about its longitudinal axis;

a seam lever mounted on the seaming shank; and at least one seam tool mounted on the seam lever for forming a first and/or second operation seam between a can end and can body flange;

characterised in that:

the seam tool is mounted via a bearing on the seam lever, the centre of the bearing being eccentric to its outside diameter;

and characterised by an external thread on the bearing which mates with a complementary worm mechanism, whereby rotation of the worm mechanism rotates the bearing and moves the seam tool radially for adjusting seam tightness.

2. An apparatus according to claim 1, in which the external thread on the bearing is a thread cut on a housing for the bearing.

3. An apparatus according to claim 1, further comprising a spacer or shim between the bearing and the seam tool for fixing seam tool height.

4. An apparatus according to claim 1, further comprising a spacer between the seam lever and the seaming shank for fixing seam lever height.

5. An apparatus according to claim 2, further comprising a spacer or shim between the bearing and the seam tool for fixing seam tool height.

6. An apparatus according to claim 2, further comprising a spacer between the seam lever and the seaming shank for fixing seam lever height.

7. An apparatus according to claim 3, further comprising a second spacer between the seam lever and the seaming shank for fixing seam lever height.

8. A method of adjusting seam tightness settings on a seamer for seaming a can end to a can body, the seamer including a seam lever mounted on a seaming shank; and at least one seam tool mounted on the seam lever for forming a first and/or second operation seam between a can end and can body flange;

the method being characterised by mounting the seam tool on the seam lever via a bearing which has an external thread, with the centre of the bearing eccentric to its outside diameter;

engaging the external thread on the bearing with a complementary worm mechanism; and rotating the worm mechanism and the bearing mated thereto, thereby moving the seam tool radially and adjusting seam tightness.

9. A method according to claim 8, further comprising fixing seam tool height with a spacer or shim between the bearing and the seam tool.

10. A method according to claim 8, further comprising fixing seam lever height by providing a spacer between the seam lever and the seaming shank.

11. A method according to claim 9, further comprising fixing seam lever height by providing a second spacer between the seam lever and the seaming shank.

* * * * *